US010309150B2

(12) United States Patent
McKenna et al.

(10) Patent No.: US 10,309,150 B2
(45) Date of Patent: Jun. 4, 2019

(54) STRUCTURAL GLAZING WEATHER SEAL WITH CAPTURED GLAZING OPTION

(71) Applicant: ARCONIC INC., Pittsburgh, PA (US)

(72) Inventors: Gregory Blake McKenna, Cumming, GA (US); Jeffrey Scott Dolby, Buford, GA (US); Christopher Robert Hartwell, Suwanee, GA (US)

(73) Assignee: Arconic Inc., Pittsburgh, PA (US)

( * ) Notice: Subject to any disclaimer, the term of this patent is extended or adjusted under 35 U.S.C. 154(b) by 0 days.

(21) Appl. No.: 15/704,594

(22) Filed: Sep. 14, 2017

(65) Prior Publication Data

US 2019/0078380 A1 Mar. 14, 2019

(51) Int. Cl.

| | |
|---|---|
| ***E06B 7/23*** | (2006.01) |
| ***E04B 2/96*** | (2006.01) |
| ***E06B 1/18*** | (2006.01) |
| ***E06B 3/64*** | (2006.01) |
| ***E06B 1/40*** | (2006.01) |
| ***E06B 3/26*** | (2006.01) |
| ***E06B 3/54*** | (2006.01) |
| ***E06B 1/36*** | (2006.01) |

(52) U.S. Cl.

CPC ..... *E06B 7/2303* (2013.01); *E04B 2/96* (2013.01); *E06B 1/18* (2013.01); *E06B 1/366* (2013.01); *E06B 1/40* (2013.01); *E06B 3/26* (2013.01); *E06B 3/5481* (2013.01); *E06B 3/64* (2013.01)

(58) Field of Classification Search

CPC ..... E06B 7/2303; E06B 1/366; E06B 3/5481; E06B 3/26; E06B 3/64; E06B 1/18; E06B 1/40; E04B 2/96

USPC ..... 52/235, 302.3, 200, 474, 204.591

See application file for complete search history.

(56) References Cited

U.S. PATENT DOCUMENTS 3,527,011 A * 9/1970 Bloom ..... E04B 2/962 49/504
3,732,659 A * 5/1973 LaBarge ..... E04B 1/6803 52/204.597

(Continued)

FOREIGN PATENT DOCUMENTS

EP 0395040 B1 12/1992
EP 2248984 B1 8/2011

(Continued)

OTHER PUBLICATIONS

International Search Report and Written Opinion dated Jan. 8, 2019, issued by the Korean Intellectual Property office in application No. PCT/US2018/050332 (14 pages).

*Primary Examiner* — Joshua K Ihezie
(74) *Attorney, Agent, or Firm* — Greenberg Traurig, LLP

(57) ABSTRACT

A weather seal that inserts into a gap between glazing panels has an H-shape with a snap-on female receiver at either end for receiving a tongue extending from a structure at one end and a cap tongue in the other. A web extending between a pair of walls provides a weather barrier and allows the walls to flex enabling the snap-on action. A pair of sealing fins and a pair of bulbs extend laterally from the H-shape, bridging the gap to exclude weather infiltration. The second receiver is covered by extensions joined at a slit permitting the weather seal to be used without a cap. Alternatively, the cap may be affixed to the weather seal by pushing a cap tongue through the slit and into engagement with the second receiver.

17 Claims, 4 Drawing Sheets

(56) References Cited

U.S. PATENT DOCUMENTS 4,117,640 A * 10/1978 Vanderstar ..... E06B 3/26338 49/DIG. 1
4,638,613 A * 1/1987 Tonsmann ..... E04B 1/24 52/200
4,650,702 A * 3/1987 Whitmyer ..... E06B 3/5427 428/31
4,691,489 A * 9/1987 Shea, Jr. ..... E06B 3/5427 52/204.593
5,018,326 A * 5/1991 Reynolds ..... E04B 2/96 52/204.591
5,076,034 A * 12/1991 Bandy ..... E04B 2/967 52/204.591
5,189,862 A * 3/1993 Lafleur ..... E06B 3/2605 52/204.593
5,222,339 A * 6/1993 Hendrickson ..... E06B 3/58 52/456
5,245,808 A * 9/1993 Grunewald ..... E06B 3/5427 52/204.593
5,481,839 A * 1/1996 Lang ..... E04B 2/967 52/235
5,644,878 A * 7/1997 Wehrmann ..... E04B 2/7457 52/235
6,360,498 B1 * 3/2002 Westphal ..... E06B 1/6007 52/204.1
7,080,488 B2 * 7/2006 Hocker ..... E04B 2/965 52/200
7,386,959 B2 * 6/2008 Ouellette ..... E06B 3/5892 24/294
9,151,056 B2 * 10/2015 Konstantin ..... E04D 3/35
9,909,306 B2 * 3/2018 Dolby ..... E04B 2/967
2002/0092248 A1 * 7/2002 Westphal ..... E06B 1/6007 52/204.5
2003/0024179 A1 * 2/2003 Cates ..... E04B 2/7457 52/204.1
2008/0010919 A1 * 1/2008 Tufts ..... E06B 1/366 52/204.591
2009/0199498 A1 * 8/2009 Ting ..... E04B 2/90 52/235
2016/0053487 A1 * 2/2016 Frederick ..... E04B 2/90 52/235

FOREIGN PATENT DOCUMENTS

KR 10-2014-0030983 A 3/2014
KR 10-2017-0073972 A 6/2017
WO 2017-079578 A1 5/2017

* cited by examiner

STRUCTURAL GLAZING WEATHER SEAL WITH CAPTURED GLAZING OPTION

FIELD

The present invention relates to apparatus and methods for sealing joints between adjacent glazing panels of a glazed panel wall construction on the exterior of a building, such as a curtain wall, storefront or the like, and more particularly, to a pre-formed seal.

BACKGROUND

Various apparatus and methods for establishing a seal between glazing panels are known. Typically, two-sided silicone structural glazing (SSG) is sealed with a wet-type seal, e.g., a silicone seal that is applied in a flowable state and that subsequently cures to a non-flowable state. Pre-formed gaskets are known that install between adjacent glass panels. For example, U.S. Pat. No. 5,245,808 discloses a weather seal retainer for structural glazing. A pre-formed gasket is also known that may be inserted between glazing panels, see PG123™ wall system from Kawneer, http://www.kawneer.com. Notwithstanding, alternative apparatus and methods for sealing glazing panels remain desirable.

SUMMARY

The disclosed subject matter relates to a weather seal for a gap between adjacent glazing panels held to a structure, having: a first wall along the length of the weather seal; a first coupling disposed along a first side of the first wall, the first coupling attaching to the structure between the gap; a second coupling disposed along a second side of the first wall distal to the first side, the second coupling capable of selectively attaching to a cap covering the joint; at least one seal member extending from the first wall intermediate the first coupling and the second coupling, the seal member at least partially bridging the gap.

In another embodiment, the first coupling is a first receiver and the structure has a tongue that inserts into the first receiver.

In another embodiment, further including a second wall extending next to the first wall along the length of the first wall, the first wall and the second wall joined by a web.

In another embodiment, the at least one seal member includes a first fin and a second fin, the first fin extending from the first wall in a direction perpendicular thereto and distal to the second wall, the second fin extending from the second wall in a direction perpendicular thereto, and distal to the first wall.

In another embodiment, the at least one seal member further includes at least one sealing bulb, the sealing bulb having a hollow therein and capable of deforming when pressed into the gap.

In another embodiment, the at least one sealing bulb includes a first sealing bulb and a second sealing bulb, the first sealing bulb extending from the first wall in a direction perpendicular thereto and distal to the second wall, the second sealing bulb extending from the second wall in a direction perpendicular thereto, and distal to the first wall.

In another embodiment, the first sealing bulb and the second sealing bulb have a cross-section approximating an egg shape, with a first portion having a smaller diameter than a second portion, the first portions leading the first and second sealing bulbs into the gap before the second portions when the weather seal is installed in the gap.

In another embodiment, the second coupling is a second receiver and further including an extension from a wall of each of the sealing bulbs, the extensions extending in a direction toward one another to define a split over the second receiver.

In another embodiment, the weather seal is made from an elastic material, the first receiver capable of deforming to a first position capable of receiving the tongue of the structure and resiliently returning to a second position interlocking with the tongue of the structure.

In another embodiment, further including a first pair of inwardly directed prominences proximate the first receiver, a first prominence of the first pair extending from the first wall toward the second wall and a second of the first pair extending from the second wall toward the first wall, wherein the tongue of the structure has recesses on opposing sides thereof, the pair of prominences extending into the recesses when the tongue of the structure is inserted into first receiver in snap-fit relationship.

In another embodiment, further including an elongated cap capable of covering the gap, the cap having a front wall with a tongue extending therefrom, wherein, the second receiver is capable of deforming to a first position receiving the tongue of the cap and resiliently returning to a second position interlocking with the tongue of the cap and further including a second pair of inwardly directed prominences proximate the second receiver, a first prominence of the second pair extending from the first wall toward the second wall and a second prominence of the second pair extending from the second wall toward the first wall, wherein the tongue of the cap has recesses on opposing sides thereof, the second pair of prominences extending into the recesses in the tongue of the cap when the tongue of the cap is inserted into the second receiver in snap-fit relationship.

In another embodiment, the extensions form a shallow V shape in cross-section, the slit at the nadir of the V shape and disposed over and in alignment with the second receiver.

In another embodiment, further including a pair of inwardly extending guide beads in the first receiver for controlling the frictional interaction of the receiver with the tongue of the structure.

In another embodiment, a glazing structure includes: a glazing support member with a coupling member extending there from; a pair of glazing panels attached to the glazing support member with a gap there between; a weather seal inserted into the gap bridging between the pair of glazing panels, the weather seal having a first wall along the length thereof with a first coupling disposed along a first side, the first coupling attaching to the coupling member between the gap, a second coupling disposed along a second side of the first wall distal to the first side and a seal member extending from the first wall to at least one of the glazing panels.

In another embodiment, the first coupling and the second coupling are first and second receivers and the coupling member is a tongue that inserts into the first receiver, the weather seal further including a second wall extending next to the first wall along the length of the first wall, the first wall and the second wall joined by a web forming an H-shape in cross-section, wherein the seal member includes a pair of sealing fins, a first fin extending from the first wall in a direction perpendicular thereto and distal to the second wall, a second fin extending from the second wall in a direction perpendicular thereto, and distal to the first wall, and further comprising a pair of sealing bulbs having a hollow therein and capable of deforming when pressed into the gap, a first of the pair of sealing bulbs extending from the first wall in a direction perpendicular thereto and distal to the second wall, the second sealing bulb extending from the second wall in a direction perpendicular thereto, and distal to the first wall.

In another embodiment, the first sealing bulb and the second sealing bulb have a cross-section approximating an egg shape, with a first portion having a smaller diameter than a second portion, the first portions leading the first and second sealing bulbs into the gap before the second portions when the weather seal is installed in the gap, further including an extension from a wall of each of the sealing bulbs, the extensions extending in a direction toward one another and meeting to define a split over the second receiver.

In another embodiment, further including an elongated cap capable of covering the gap, the cap having a front wall with a tongue extending therefrom, the tongue of the cap being received in snap-fitting relationship into the second receiver.

In another embodiment, a method for sealing a gap between glazing panels, includes the steps of: providing a structure for supporting at least two glazing panels adjacent to each other with a gap between, the structure having a coupling member extending into the gap; providing an elongated weather seal having a first coupling disposed along a first longitudinal side and a second coupling disposed along a second longitudinal side and a seal member extending in a generally perpendicular direction relative the length of the weather seal, the weather seal having a penetrable barrier covering the second coupling; inserting the weather seal into the gap; coupling the first coupling of the weather seal to the coupling member of the structure, weather seal being held in position in the gap with the seal member at least partially bridging a width of the gap.

In another embodiment, further including the steps of providing an elongated cap with a front wall with a tongue extending therefrom; pushing the tongue of the cap into the second receiver; interlocking the tongue of the cap with the second receiver.

In another embodiment, further including the step of penetrating the penetrable barrier of the weather seal prior to the step of pushing and deforming the second receiver prior to the step of interlocking.

BRIEF DESCRIPTION OF THE DRAWINGS

For a more complete understanding of the present disclosure, reference is made to the following detailed description of exemplary embodiments considered in conjunction with the accompanying drawings.

DETAILED DESCRIPTION OF EXEMPLARY EMBODIMENTS

An aspect of the present disclosure is the recognition that it would be beneficial to have a preformed weather seal for sealing a joint between adjacent glazing units that allows a cap structure to be attached to the joint at a predetermined relative position, e.g., parallel to and centered over the jot and without use of a flowable (liquid) sealant, such as silicone seal to attach the cap.

An aspect of the present disclosure is to provide a multi-function rain screen gasket. In one embodiment, the rain screen gasket includes a resiliently flexible front face and resiliently flexible back fins to provide two mechanisms to resist water penetration. In an embodiment, the rain screen gasket includes at least two retainer snaps, an interior retainer snap, which fixes the gasket to the face of a mullion, i.e., between two glass lites (glazing panels), and an exterior retainer snap to fix an exterior cover to the gasket for aesthetic and sealing purposes.

According to aspects of the present disclosure, an assembly is disclosed that allows the window wall glazing system or curtain wall glazing system to perform whether the exterior cover is present or not. According to aspects illustrated herein, in one embodiment, a window wall glazing system or curtain wall glazing system includes at least two insulating glass units, at least two methods for fixing glass lites of the insulating glass units in place on both sides of a mullion (SSG or tape applied), and at least one rain screen gasket for providing a rain screen seal between the glass lites or panels against water/weather penetration.

Figure 1:
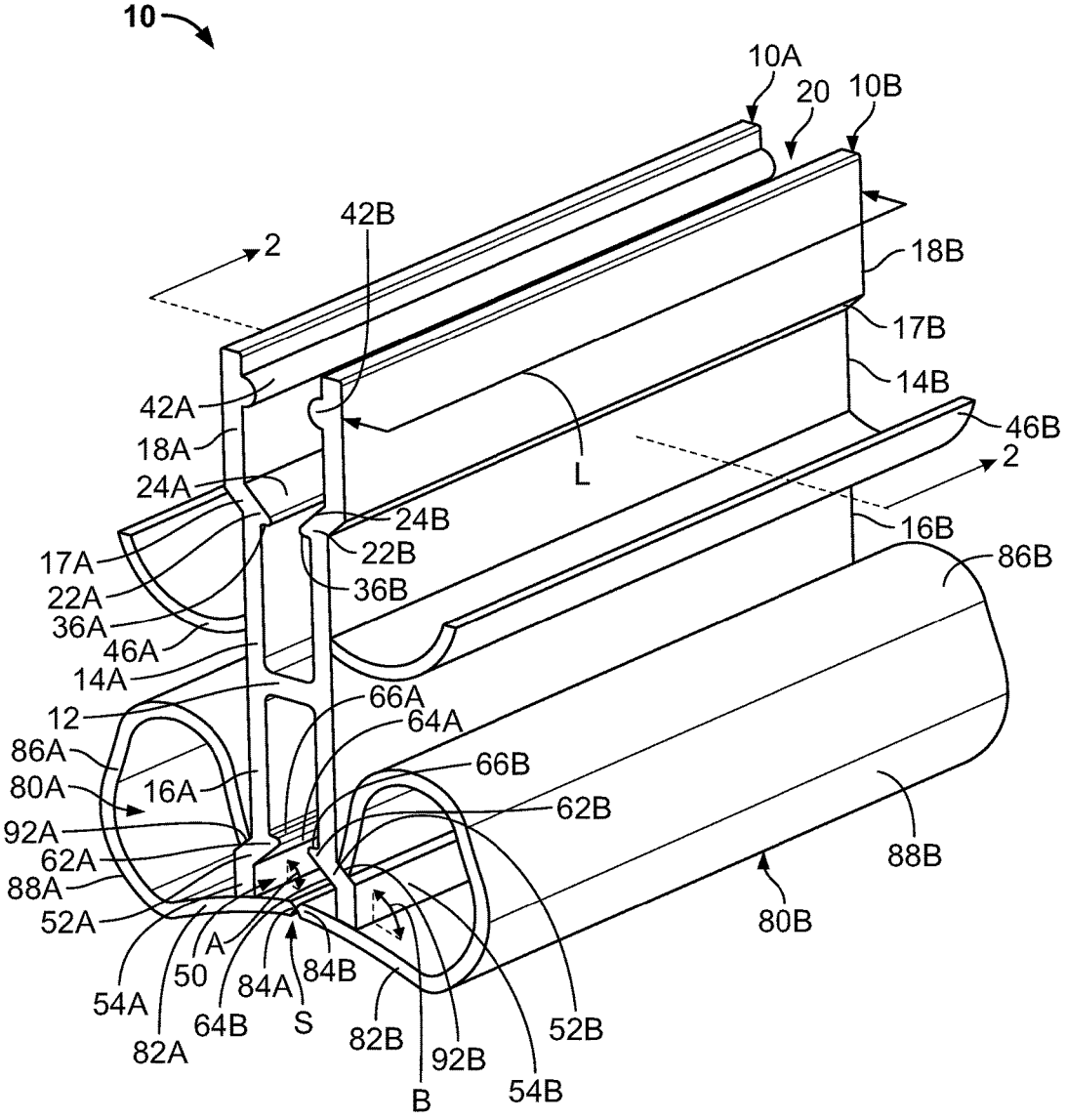
FIG. 1 is a perspective view of a weather seal in accordance with an embodiment of the present disclosure.
Figure 2:
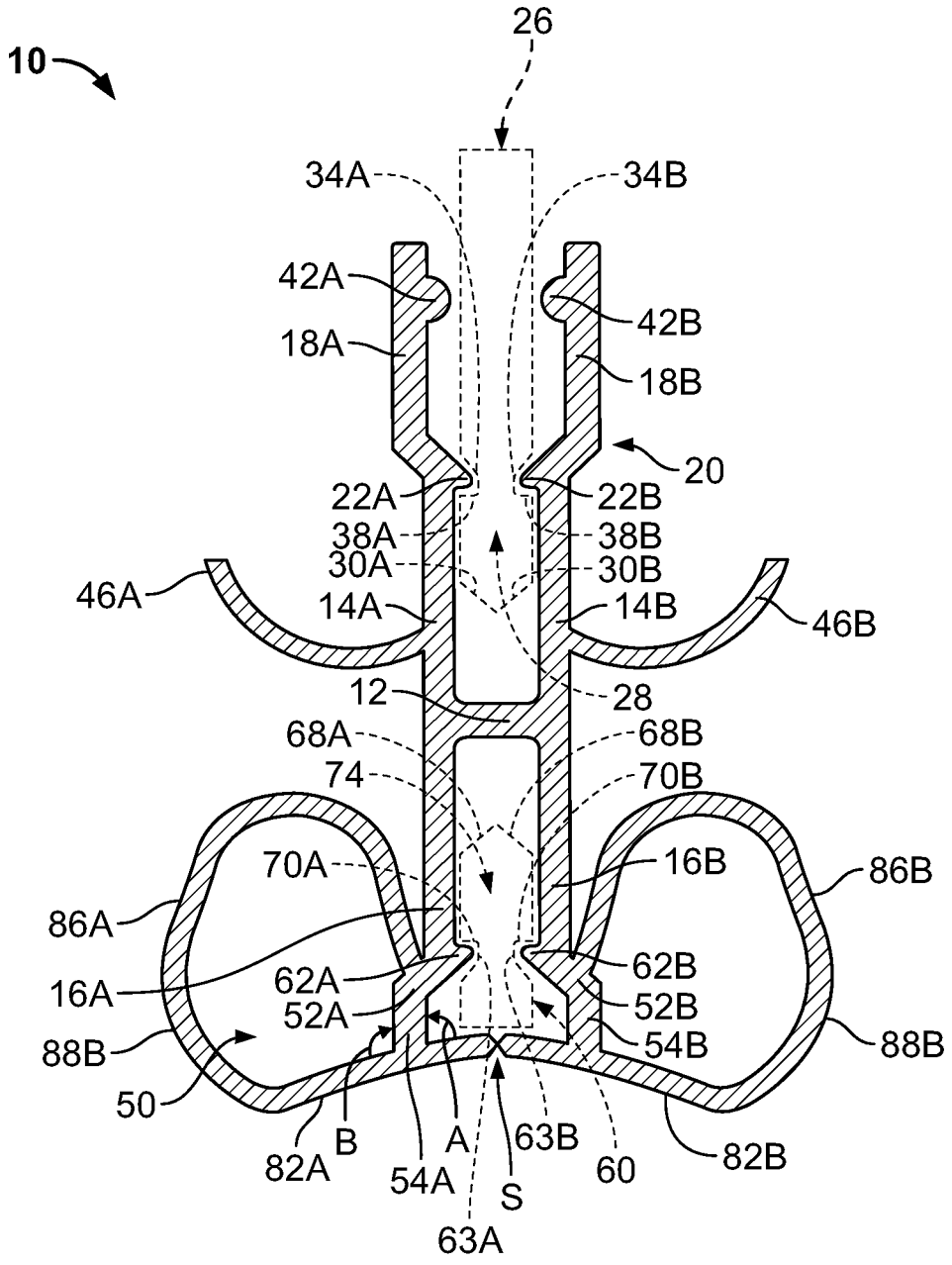
FIG. 2 is a cross-sectional view of the weather seal of FIG. 1, taken along section line 2-2 and looking in the direction of the arrows.

FIGS. 1 and 2 show a weather seal 10 in accordance with an embodiment of the present disclosure. In one embodiment, the weather seal 10 is bilaterally symmetric with two portions 10A and 10B conjoined by a bridging web 12. The web 12 serves to connect portions 10A and 10B and also to act as a weather seal. The length L of the weather seal 10 may approximate the length of the glazing panels between which it is inserted and may extend beyond a glazing panel to bridge the space between the next set of adjacent glazing panels, e.g., above and below the panels between which it is inserted. In one alternative, the weather seal 10 may be of a length L to extend the length of a plurality of glazing panels and/or may be cut to length at the time of use.

Each of portions 10A and 10B have a first wall 14A, 14B and a second wall 16A, 16B extending away from the web 12 and forming an H shaped cross-sectional shape. Short, angled flare walls 17A, 17B result in first end walls 18A, 18B being laterally, outwardly offset from first walls 14A, 14B to form a receiver 20. Proximate the flare walls 17A, 17B, inwardly directed prominences 22A, 22B extend. The prominences 22A, 22B have sloped inner surfaces 24A, 24B that serve as guides to introduce a tongue 26 there between. The tongue 26 may be provided with a tip 28 having sloped surfaces 30A, 30B that encounter and slide over the prominences 22A, 22B in wedging fashion when the tongue 26 is inserted into the receiver 20. The weather seal 10 may be formed from an elastic polymer, such as polypropylene, TPV, santoprene, polyamide or PVC, which may be extruded to form the weather seal 10. The elasticity of the weather seal 10 allows the receiver 20 is spread apart when the tip 28 of the tongue 26 is pressed past the prominences 22A, 22B. The tongue 26 has recesses 34A, 34B that receive the prominences 22A, 22B, allowing the receiver 20 to assume a relaxed position with interior flat surfaces 36A, 36B of the prominences 22A, 22B abutting flat surfaces 38A, 38B of the recesses 34A, 34B and locking the tongue 26 in the recess 34A, 34B. Inwardly directed guide beads 42A, 42B provide centering of the tongue 26 as it is introduced into and held in the receiver 20. The guide beads 42A, 42B also provide a frictional interaction of predetermined magnitude between the tongue 26 and the weather seal 10 that aids in holding the weather seal 10 in position on the tongue, but that does not impede installation or repositioning of the weather seal 10.

Figure 3:
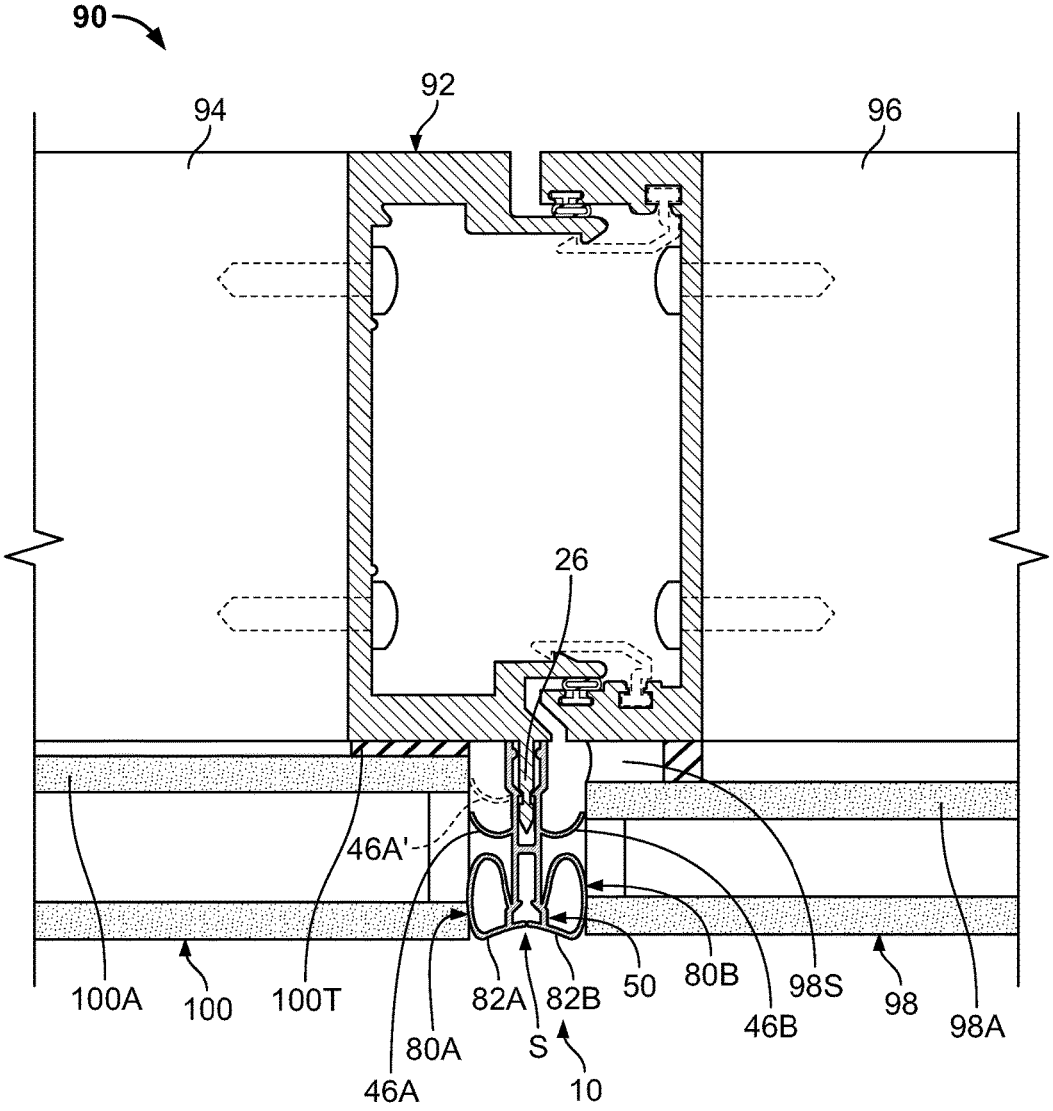
FIG. 3 is cross-sectional view of a glazing support structure and glazing panels on which the weather seal of FIGS. 1 and 2 is installed.
Figure 4:
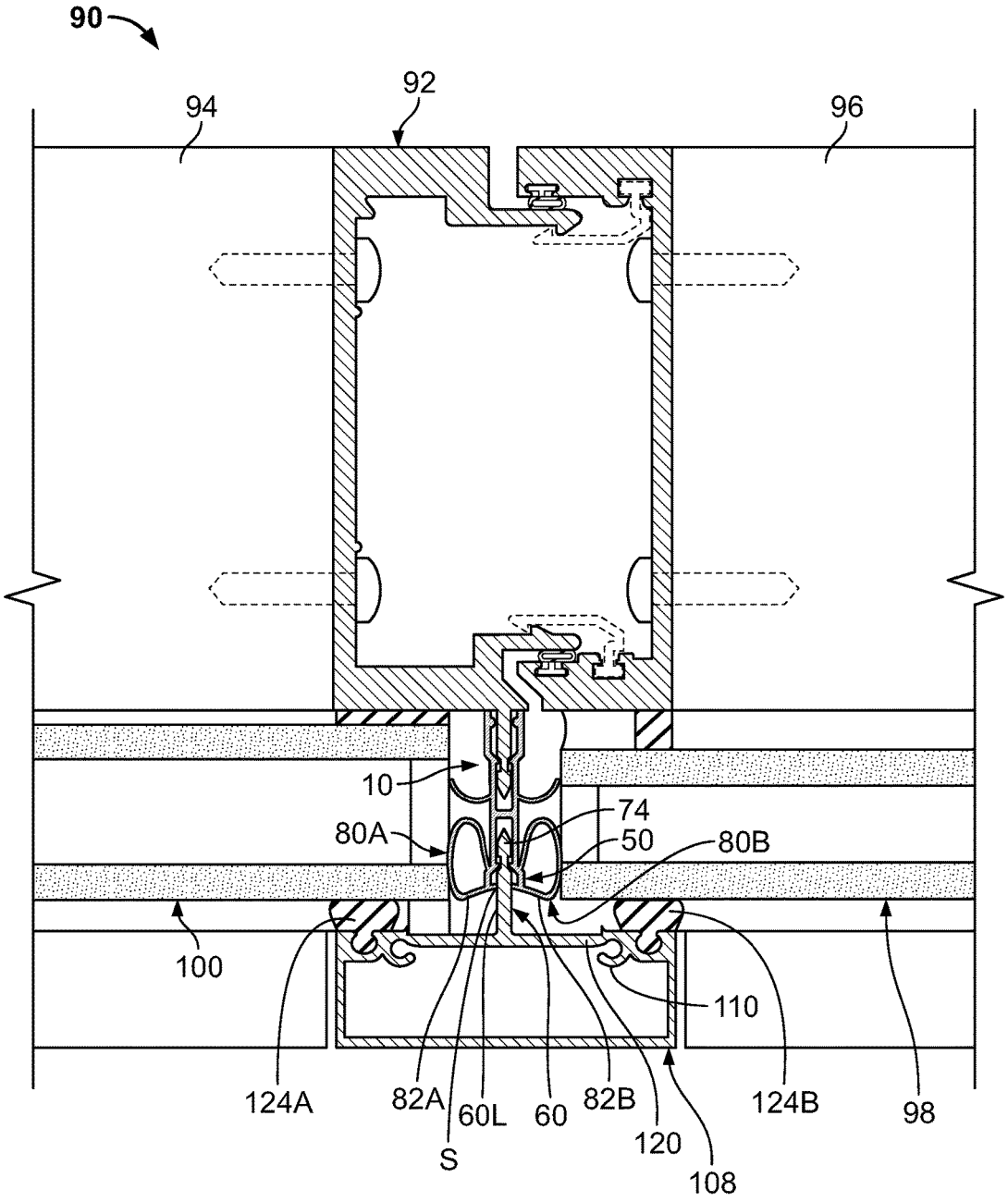
FIG. 4 is a cross-sectional view of the structure of FIG. 3, further including a cap.

Each of the portions 10A, 10B have a sealing fin 46A, 46B extending outwardly therefrom at an intermediate position, e.g., proximate web 12. As shown in FIG. 3, the sealing fins 46A, 46B create an inboard seal as a second line of defense for water penetration, e.g., by resiliently pressing against an inboard glazing panel member 98A, 100A when the weather seal 10 is inserted between glazing panels 98, 100. The sealing fins 46A, 46B may have an arcuate cross-sectional shape to increase the flexibility thereof to allow for assembly and material tolerance. In one embodiment, the sealing fins may curve in the opposite direction. The weather seal 10 has a second receiver 50 distal to the receiver 20, at the end of second walls 16A, 16B, that is defined by flared walls 52A, 52B and end walls 54A, 54B. The receiver 50 receives a cap tongue 60 that extends from a cap 108, as shown in FIG. 4. As with the first receiver 20, receiver 50 has a pair of inwardly directed prominences 62A, 62B that may be received in recesses 63A, 63B in the cap tongue 60. Sloped surfaces 64A, 64B, 68A, 68B, flat surfaces 66A, 66B and flat surfaces 70A, 70B of tip 74 perform the same functions as explained above relative to sloped surfaces 24A, 24B, 30A, 30B, flat surfaces 36A, 36B and flat surfaces 38A, 38B of tip 28. As with the receiver 20, receiver 50 can deform to receive the tip 74 and then return to a relaxed position, gripping the tip 74 and preventing its withdrawal from the receiver 50.

Portions 10A, 10B also feature sealing bulbs 80A, 80B that extend from the end walls 54A, 54B. The sealing bulbs 80A, 80B are generally oval in cross section. The oval shapes may be modified by substantially flat portions 82A, 82B that join end walls 54A, 54B at an acute interior angle A and an obtuse exterior angle B. In one embodiment, angles A and B may both be close to 90 degrees. The flat portions 82A, 82B have ends 84A, 84B that approach and optionally touch one another, leaving a split S and covering the receiver 50 when in a relaxed position. The oval shape of the sealing bulbs 80A, 80B may also be modified by narrowed interior portions 86A, 86B that ease entry of the sealing bulbs 80A, 80B into the gap between adjacent glazing panels 98, 100. Bulging portions 88A, 88B insure the sealing bulbs 80A, 80B extend across and seal the gap between glazing panels 98, 100. The sealing bulbs 80A, 80B may be closed, with ends 92A, 92B monolithically extending from the receiver 50 (at or proximate to the flare walls 52A, 52B), increasing the rigidity of the sealing bulbs 80A, 80B. Alternatively, the ends 92A, 92B may be formed independently of and abut against the flare walls 52A, 52B, decreasing the rigidity of the sealing bulbs 80A, 80B.

FIGS. 3 and 4 show a glazed structure 90 with structural members 92, 94, 96 and glazing panels 98, 100. The glazing panels 98, 100 shown are of different thicknesses and are held to the structural members 92 (a vertical mullion with a composite construction), 94, 96 (horizontal mullions) by different means. In actual use, only one type of glazing panel and attachment approach would typically be used for a particular application. FIGS. 3 and 4 illustrate, however, that the weather seal 10 may be used in a range of applications. Glazing panel 98 is adhered to the structural members 92, 94, 96 by structural silicone glazing (SSG) techniques and materials, which are known in the art and are indicated by the silicone seal 98S. Glazing panel 100 is adhered to the structural members 92, 94, 96 by structural tape glazing techniques and materials, which are also known in the art and are indicated by the structural tape 100T. The weather seal 10 is inserted between the adjacent glazing panels 98, 100 after they are attached to the structural members 92, 94, 96, spanning the gap there between and reducing or excluding weather infiltration in the form of precipitation and ambient air and radiation. As noted above, weather seal 10 locks on the tongue 26 extending from the structural member 92. The weather seal 10 may be used to seal horizontal gaps between adjacent glazing panels like 98, 100 in a manner similar to the sealing of a vertical gap, as shown. An alternative position for a sealing fin 46A' may be employed to allow the fin 46A' to seal against another portion of the glazing panel 100 (e.g., the inner glass 100A). As a further alternative, the weather seal 10 may be provided with a plurality of sealing fins 46A, 46B, e.g., two or three on each side, to be able to adapt to a variety of applications. As shown in FIG. 3, the flat surfaces 82A, 82B of the sealing bulbs 80A, 80B define a shallow V shape with a split S at the bottom of the V. The shallow V shape induces an approaching cap tongue 60 (FIG. 2, FIG. 4) to move toward and through the split S and into alignment with the receiver 50.

FIG. 4 shows a cap 108, e.g., made from a metal, such as an aluminum alloy. In one alternative, the cap 108 may be made from one or a combination of an aluminum alloy and a polymer, such as polypropylene, TPV, santoprene, polyamide or PVC. In one embodiment, the cap 108 may be produced by extrusion and has a generally rectangular cross-section. Strengthening ribs 110 may be used to increase rigidity. A cap tongue 60 with a tip 74, recesses 63A, 63B (FIG. 2) and lower portion 60L extends from a front wall 120 of the cap 108. As described in reference to FIG. 2, the tip 74 may be inserted into the second receiver 50 and interlock with the weather seal 10 preventing withdrawal therefrom. The weather seal 10 provides a sealing function as well as a cap 108 installation and retention function. The lower portion 60L extends through the slit S, pushing the sealing bulbs 80A, 80B into closer engagement with the glazing panels 98, 100. The cap may include gaskets 124A, 124B that intermediate between the cap 108 and the glazing panels 98, 100, as well as providing an additional weather seal.

A weather seal 10 is disclosed herein which incorporates the benefits of a preformed gasket used in SSG conditions along with cap attachment features. The attachment features are concealed behind the exterior surface of the weather seal 10. This dual functionality provides a single seal system that can optionally be used to achieve the aesthetic and functional effects of either a flush SSG system or a captured system. The weather seal 10 allows for positive engagement of the cap 108 by splitting along the face of the weather seal 10 during attachment of the cap 108, which then snaps into place in the receiver 50. The positive engagement of the cap 108 with the weather seal 10 eliminates the structural silicone seal otherwise needed to affix the cap 108 to adjacent glazing panels. The weather seal 10 assures accurate alignment and positioning relative to the glazing panels 98, 100.

It will be understood that the embodiments described herein are merely exemplary and that a person skilled in the art may make many variations and modifications without departing from the spirit and scope of the claimed subject matter. For example, while the receivers 20, 50 are shown as female coupling devices that receive a male tongue 26, 60 extending from the structure 92 and the cap 108, this relationship could be reversed in one or both instances. For example, the tongue 26 could have a slot therein into which a male tongue extending from the weather seal 10 is inserted and snap-locked into place. Similarly, the weather seal could have a second male tongue that inserts into a slot formed in the cap 108 at the position where the male tongue 60 is situated in the illustrated embodiments. All such variations and modifications are intended to be included within the scope of the appended claims.

We claim:

1. A weather seal for a gap between adjacent side edges of first and second co-planar glazing panels held to a structure, comprising:

a first wall along the length of the weather seal;

a second wall extending next to the first wall along the length of the first wall;

a web wall joining the first wall and the second wall, the first wall and the second wall spaced one from another;

a first coupling disposed along a first side of the first wall and the second wall, the first coupling attaching to the structure between the gap;

a second coupling disposed along a second side of the first wall and the second wall distal to the first side, the second coupling capable of selectively attaching to a cap covering the joint;

a first seal member extending from the first wall in a direction distal to the second wall and intermediate the first coupling and the second coupling;

a second seal member extending from the second wall in a direction distal to the first wall and intermediate the first coupling and the second coupling; the weather seal bridging the gap with the first seal member contacting a side edge of the first glazing panel and the second seal member contacting a side edge of the second glazing panel, wherein the first seal member is a flexible arcuate fin and the second seal member is a flexible arcuate fin, the first seal member contacting the side edge of the first glazing panel proximate an end of the first seal member and the second seal member contacting the side edge of the second glazing panel proximate an end of the second seal member.

2. The weather seal of claim 1, wherein the first coupling is a first receiver and the structure has a tongue that inserts into the first receiver.

3. The weather seal of claim 1, further comprising at least one sealing bulb extending from the first wall proximate the second coupling, the sealing bulb having a hollow therein and capable of deforming when pressed into the gap.

4. The weather seal of claim 3, wherein the at least one sealing bulb includes a first sealing bulb and a second sealing bulb, the first sealing bulb extending from the first wall in a direction perpendicular thereto and distal to the second wall, the second sealing bulb extending from the second wall in a direction perpendicular thereto, and distal to the first wall.

5. The weather seal of claim 4, wherein the first sealing bulb and the second sealing bulb have a cross-section approximating an egg shape, with a first portion having a smaller diameter than a second portion, the first portions leading the first and second sealing bulbs into the gap before the second portions when the weather seal is installed in the gap.

6. A weather seal for a gap between adjacent side edges of first and second co-planar glazing panels held to a structure, comprising:

a first wall along the length of the weather seal;

a second wall extending next to the first wall along the length of the first wall;

a web wall joining the first wall and the second wall, the first wall and the second wall spaced one from another;

a first coupling disposed along a first side of the first wall and the second wall, the first coupling attaching to the structure between the gap;

a second coupling disposed along a second side of the first wall and the second wall distal to the first side, the second coupling capable of selectively attaching to a cap covering the joint;

a first seal member extending from the first wall in a direction distal to the second wall and intermediate the first coupling and the second coupling;

a second seal member extending from the second wall in a direction distal to the first wall and intermediate the first coupling and the second coupling; the weather seal bridging the gap with the first seal member contacting a side edge of the first glazing panel and the second seal member contacting a side edge of the second glazing panel, wherein the first coupling is a first receiver and the structure has a tongue that inserts into the first receiver, wherein the first seal member and the second seal member are a first fin and a second fin, respectively, the first fin extending from the first wall in a direction perpendicular thereto and distal to the second wall, and the second fin extending from the second wall in a direction perpendicular thereto and distal to the first wall, further comprising at least one sealing bulb extending from the first wall proximate the second coupling, the sealing bulb having a hollow therein and capable of deforming when pressed into the gap, wherein the at least one sealing bulb includes a first sealing bulb and a second sealing bulb, the first sealing bulb extending from the first wall in a direction perpendicular thereto and distal to the second wall, the second sealing bulb extending from the second wall in a direction perpendicular thereto, and distal to the first wall, wherein the first sealing bulb and the second sealing bulb have a cross-section approximating an egg shape, with a first portion having a smaller diameter than a second portion, the first portions leading the first and second sealing bulbs into the gap before the second portions when the weather seal is installed in the gap, wherein the second coupling is a second receiver and further including an extension from a wall of each of the sealing bulbs, the extensions extending in a direction toward one another to define a split over the second receiver.

7. The weather seal of claim 6, wherein the weather seal is made from an elastic material, the first receiver capable of deforming to a first position capable of receiving the tongue of the structure and resiliently returning to a second position interlocking with the tongue of the structure.

8. The weather seal of claim 7, further including a first pair of inwardly directed prominences proximate the first receiver, a first prominence of the first pair extending from the first wall toward the second wall and a second of the first pair extending from the second wall toward the first wall, wherein the tongue of the structure has recesses on opposing sides thereof, the pair of prominences extending into the recesses when the tongue of the structure is inserted into first receiver in snap-fit relationship.

9. The weather seal of claim 8, further including an elongated cap capable of covering the gap, the cap having a front wall with a tongue extending therefrom, wherein, the second receiver is capable of deforming to a first position receiving the tongue of the cap and resiliently returning to a second position interlocking with the tongue of the cap and further including a second pair of inwardly directed prominences proximate the second receiver, a first prominence of the second pair extending from the first wall toward the second wall and a second prominence of the second pair extending from the second wall toward the first wall, wherein the tongue of the cap has recesses on opposing sides thereof, the second pair of prominences extending into the recesses in the tongue of the cap when the tongue of the cap is inserted into the second receiver in snap-fit relationship.

10. The weather seal of claim 9, wherein the extensions form a shallow V shape in cross-section, the slit being positioned at a bottom of the V shape and being disposed over and in alignment with the second receiver.

11. The weather seal of claim 10, further comprising a pair of inwardly extending guide beads in the first receiver for controlling the frictional interaction of the receiver with the tongue of the structure.

12. A glazing structure, comprising:

a glazing support member with a coupling member extending there from;

a pair of glazing panels attached to the glazing support member with a gap between the side edges thereof;

a weather seal inserted into the gap bridging between the pair of glazing panels, the weather seal having a first wall along the length thereof, a second wall extending next to the first wall along the length of the first wall, a web wall joining the first wall and the second wall, the first wall spaced from the second wall;

with a first coupling disposed along a first side of the first wall and the second wall, the first coupling attaching to the coupling member between the gap, a second coupling disposed along a second side of the first wall and the second wall distal to the first side, a first seal member extending from the first wall to the side edge of a first of the pair of glazing panels and a second seal member extending from the second wall to a side edge of a second of the pair of glazing panels, wherein the first seal member is a flexible arcuate fin and the second seal member is a flexible arcuate fin, the first seal member contacting the side edge of the first glazing panel proximate an end of the first seal member and the second seal member contacting the side edge of the second glazing panel proximate an end of the second seal member.

13. The glazing structure of claim 12, wherein the first coupling and the second coupling are first and second receivers and the coupling member is a tongue that inserts into the first receiver and wherein, the first wall and the second wall joined by the web wall form an H-shape in cross-section, and further comprising a pair of sealing bulbs having a hollow therein and capable of deforming when pressed into the gap, a first of the pair of sealing bulbs extending from the first wall in a direction perpendicular thereto and distal to the second wall, the second sealing bulb extending from the second wall in a direction perpendicular thereto, and distal to the first wall.

14. A glazing structure, comprising:

a glazing support member with a coupling member extending there from;

a pair of glazing panels attached to the glazing support member with a gap there between;

a weather seal inserted into the gap bridging between the pair of glazing panels, the weather seal having a first wall along the length thereof with a first coupling disposed along a first side, the first coupling attaching to the coupling member between the gap, a second coupling disposed along a second side of the first wall distal to the first side and a seal member extending from the first wall to at least one of the glazing panels, wherein the first coupling and the second coupling are first and second receivers and the coupling member is a tongue that inserts into the first receiver, the weather seal further comprising a second wall extending next to the first wall along the length of the first wall, the first wall and the second wall joined by a web forming an H-shape in cross-section, wherein the seal member includes a pair of sealing fins, a first fin extending from the first wall in a direction perpendicular thereto and distal to the second wall, a second fin extending from the second wall in a direction perpendicular thereto, and distal to the first wall, and further comprising a pair of sealing bulbs having a hollow therein and capable of deforming when pressed into the gap, a first of the pair of sealing bulbs extending from the first wall in a direction perpendicular thereto and distal to the second wall, the second sealing bulb extending from the second wall in a direction perpendicular thereto, and distal to the first wall, wherein the first sealing bulb and the second sealing bulb have a cross-section approximating an egg shape, with a first portion having a smaller diameter than a second portion, the first portions leading the first and second sealing bulbs into the gap before the second portions when the weather seal is installed in the gap, further including an extension from a wall of each of the sealing bulbs, the extensions extending in a direction toward one another and meeting to define a split over the second receiver.

15. The glazing structure of claim 14, further including an elongated cap capable of covering the gap, the cap having a front wall with a tongue extending therefrom, the tongue of the cap being received in snap-fitting relationship into the second receiver.

16. A method for sealing a gap between glazing panels, comprising the steps of:

(A) providing a structure for supporting at least two glazing panels adjacent to each other with a gap between, the structure having a coupling member extending into the gap;

(B) attaching the glazing panels to the structure;

(C) providing an elongated weather seal having a first coupling disposed along a first longitudinal side and a second coupling disposed along a second longitudinal side and a seal member extending in a generally perpendicular direction relative to the length of the weather seal, the weather seal having a penetrable barrier covering the second coupling;

(D) inserting the weather seal into the gap;

(E) interlocking the first coupling of the weather seal to the coupling member of the structure, the weather seal being held in position in the gap with the seal member bridging a width of the gap;

(F) providing an elongated cap with a front wall with a tongue extending therefrom;

(G) pushing the tongue of the cap into the second;

(H) interlocking the tongue of the cap with the second coupling.

17. The method of claim 16, further comprising the step of penetrating the penetrable barrier of the weather seal prior to the step of pushing and deforming the second coupling prior to the step of interlocking.

* * * * *